US009123334B2

(12) United States Patent
Morii

(10) Patent No.: US 9,123,334 B2
(45) Date of Patent: Sep. 1, 2015

(54) VECTOR QUANTIZATION OF ALGEBRAIC CODEBOOK WITH HIGH-PASS CHARACTERISTIC FOR POLARITY SELECTION

(75) Inventor: Toshiyuki Morii, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 406 days.

(21) Appl. No.: 13/515,076

(22) PCT Filed: Dec. 13, 2010

(86) PCT No.: PCT/JP2010/007222

§ 371 (c)(1), (2), (4) Date: Jun. 11, 2012

(87) PCT Pub. No.: WO2011/074233

PCT Pub. Date: Jun. 23, 2011

(65) Prior Publication Data

US 2012/0278067 A1 Nov. 1, 2012

(30) Foreign Application Priority Data

Dec. 14, 2009 (JP) ..... 2009-283247

(51) Int. Cl.

*G10L 19/10* (2013.01)
*G10L 19/107* (2013.01)
*G10L 19/00* (2013.01)

(52) U.S. Cl.

CPC ..... *G10L 19/107* (2013.01); *G10L 2019/0013* (2013.01)

(58) Field of Classification Search

CPC ..... G10L 19/08; G10L 19/10; G10L 19/107; G10L 19/12; G10L 2019/0008; G10L 2019/0013

USPC ..... 704/221, 222, 225, 230

See application file for complete search history.

(56) References Cited

U.S. PATENT DOCUMENTS 5,226,085 A * 7/1993 Di Francesco ..... 704/219
5,245,662 A * 9/1993 Taniguchi et al. ..... 704/219

(Continued)

FOREIGN PATENT DOCUMENTS

JP 8-263100 10/1996
JP 11/501131 1/1999

(Continued)

OTHER PUBLICATIONS

Search report from E.P.O., mail date is Dec. 6, 2013.

(Continued)

*Primary Examiner* — Martin Lerner

(74) *Attorney, Agent, or Firm* — Greenblum & Bernstein P.L.C.

(57) ABSTRACT

Provided are a vector quantization device, a voice coding device, a vector quantization method, and a voice coding method which enable a reduction in the calculation amount of voice codec without deterioration of voice quality. In the vector quantization device, a first reference vector calculation unit (201) calculates a first reference vector by multiplying a target vector (x) by an auditory weighting LPC synthesis filter (H), and a second reference vector calculation unit (202) calculates a second reference vector by multiplying an element of the first reference vector by a filter having a high pass characteristic. A polarity preliminary selection unit (205) generates a polar vector by disposing a unit pulse having a positive or negative polarity, which is selected on the basis of the polarity of an element of the second reference vector, in the position of said element.

7 Claims, 3 Drawing Sheets

(56) References Cited

U.S. PATENT DOCUMENTS

| | | | | |
|---|---|---|---|---|
| 5,396,576 | A * | 3/1995 | Miki et al. | 704/222 |
| 5,774,838 | A | 6/1998 | Miseki et al. | |
| 5,797,119 | A * | 8/1998 | Ozawa | 704/223 |
| 5,867,814 | A * | 2/1999 | Yong | 704/216 |
| 6,807,527 | B1 * | 10/2004 | Rozhdestvenskij et al. | 704/223 |
| 7,546,239 | B2 * | 6/2009 | Yasunaga et al. | 704/223 |
| 7,809,558 | B2 * | 10/2010 | Morii | 704/222 |
| 8,112,271 | B2 * | 2/2012 | Morii | 704/223 |
| 8,352,254 | B2 * | 1/2013 | Ehara | 704/223 |
| 2005/0154584 | A1 * | 7/2005 | Jelinek et al. | 704/219 |
| 2005/0228652 | A1 | 10/2005 | Ehara et al. | |
| 2008/0126085 | A1 * | 5/2008 | Morii | 704/222 |
| 2009/0222273 | A1 * | 9/2009 | Massaloux et al. | 704/500 |
| 2009/0292534 | A1 * | 11/2009 | Ehara | 704/219 |

FOREIGN PATENT DOCUMENTS

| | | |
|---|---|---|
| JP | 2007-293254 | 11/2007 |
| WO | 96/28810 | 7/1998 |
| WO | 03/071522 | 8/2003 |

OTHER PUBLICATIONS

"Coding of Speech At 8 kbit/s Using Conjugate-Structure Algebraic-Code-Excited Linear-Prediction (CS-ACELP)", ITU-T Recommendation G.729, Mar. 1996.

"Development of Speech/Audio Codec for Next-Generation Mobile Communication Systems", ITU-T G718, Apr. 2009, vol. 55 No. 1.

"ITU-T G.718—Frame error robust narrow—band and wideband embedded variable bit—rate coding of speech and audio from 8-32 kbit/s," XP055087883, Jun. 30, 2008.

Search report from E.P.O., mail date is Dec. 16, 2013.

* cited by examiner

VECTOR QUANTIZATION OF ALGEBRAIC CODEBOOK WITH HIGH-PASS CHARACTERISTIC FOR POLARITY SELECTION

TECHNICAL FIELD

The present invention relates to a vector quantization apparatus, a speech coding apparatus, a vector quantization method, and a speech coding method.

BACKGROUND ART

Mobile communications essentially require compressed coding of digital information of speech and images, for efficient use of transmission band. Especially, expectations for speech codec (encoding and decoding) techniques widely used for mobile phones are high, and further improvement of sound quality is demanded for conventional high-efficiency coding of high compression performance. Also, since speech communication is used by the public, standardization of the speech communication is essential, and research and development being actively undertaken by business enterprises worldwide for the high value of associated intellectual property rights derived from the standardization.

In recent years, standardization of a scalable codec having a multilayered structure has been studied by the ITU-T (International Telecommunication Union-Telecommunication Standardization Sector) and MPEG (Moving Picture Experts Group), and a more efficient and higher-quality speech codec has been sought.

A speech coding technology whose performance has been greatly improved by CELP (Code Excited Linear Prediction), which is a basic method modeling the vocal tract system of speech established 20 years ago and adopting vector quantization, has been widely used as a standard method of ITU-T standard G.729, G.722.2, ETSI (European Telecommunications Standards Institute) standard AMR (Adaptive Multi-Rate), AMR-WB (Wide Band), 3GPP2 (Third Generation Partnership Project 2) standard VMR-WB (Variable Multi-Rate-Wide Band) or the like (see Non-Patent Literature 1, for example).

In a fixed codebook search of the above Non-Patent Literature 1 ("3.8 Fixed codebook-Structure and search"), a search of a fixed codebook formed with an algebraic codebook is described. In a fixed codebook search, vector (d(n)) used for calculating a numerator term of equation (53) is found by synthesizing a target signal (x'(i), equation (50) using a perceptual weighting LPC synthesis filter (equation (52)), the target signal being acquired by subtracting an adaptive codebook vector (equation (44)) multiplied by a perceptual weighting LPC synthesis filter from an input speech through a perceptual weighting filter, and a pulse polarity corresponding to each element is preliminary selected according to the polarity (positive/negative) of the vector element. Next, a pulse position is searched using multiple loops. At this time, a polarity search is omitted.

Also, Patent Literature 1 discloses polarity pre-selection (positive/negative) and pre-processing for saving the amount of calculation disclosed in Non-Patent Literature 1. Using the technology disclosed in Patent Literature 1, the amount of calculation for an algebraic codebook search is significantly reduced. The technology disclosed in Patent Literature 1 is employed for ITU-T standard G.729 and is widely used.

CITATION LIST

Patent Literature

PLT 1
Published Japanese Translation No. H11-501131 of the PCT International Publication

Non-Patent Literature

NPL 1
ITU-T standard G.729
NPL 2
ITU-T standard G.718

SUMMARY OF INVENTION

Technical Problem

However, although a pre-selected pulse polarity is identical to a pulse polarity in a case where positions and polarities are all searched in most cases, but there may be the case of indicating "an erroneous selection" in which such polarities cannot be fitted to each other. In this case, a non-optimal pulse polarity is selected and this leads to degradation of sound quality. On the other hand, in a wideband speech codec, a method for pre-selecting a fixed codebook pulse polarity has a great effect on reducing the amount of calculation as above. Accordingly, a method for pre-selecting a fixed codebook pulse polarity is employed for various international standard schemes of ITU-T standard G.729. However, degradation of sound quality due to a polarity selection error still remains as an important problem.

It is an object of the present invention to provide a vector quantization apparatus, a speech coding apparatus, a vector quantization method, and a speech coding method that can reduce the amount of calculation of a speech codec without degrading speech quality.

Solution to Problem

A vector quantization apparatus according to the present invention is a vector quantization apparatus that searches for a pulse using an algebraic codebook formed with a plurality of code vectors and acquires a code indicating a code vector that minimizes coding distortion and employs a configuration to include the first vector calculation section that calculates the first reference vector by applying a parameter related to a speech spectrum characteristic to a coding target vector; the second vector calculation section that calculates the second reference vector by multiplying the first reference vector by a filter having a high-pass characteristic; and a polarity selecting section that generates a polarity vector by arranging a unit pulse in which one of the positive and the negative is selected as a polarity in a position of the element based on a polarity of an element of the second reference vector.

A speech coding apparatus according to the present invention is a speech coding apparatus that encodes an input speech signal by searching for a pulse using an algebraic codebook formed with a plurality of code vectors and employs a configuration to include a target vector generating section that calculates the first parameter related to a perceptual characteristic and the second parameter related to a spectrum characteristic using the speech signal, and generates a target vector to be encoded using the first parameter and the second parameter; a parameter calculation section that generates a third parameter related to both the perceptual characteristic and the spectrum characteristic using the first parameter and the second parameter; the first vector calculation section that calculates the first reference vector by applying the third parameter to the target vector; the second vector calculation section that calculates the second reference vector by multiplying the first reference vector by a filter having a high-pass characteristic; and a polarity selecting section that generates a polarity vector by arranging a unit pulse in which one of the positive and the negative is selected as a polarity in a position of the element based on a polarity of an element of the second reference vector.

A vector quantization method according to the present invention is a method for searching for a pulse using an algebraic codebook formed with a plurality of code vectors and acquiring a code indicating a code vector that minimizes coding distortion and employs a configuration to include a step of calculating the first reference vector by applying a parameter related to a speech spectrum characteristic to a target vector to be encoded; a step of calculating the second reference vector by multiplying the first reference vector by a filter having a high-pass characteristic; and a step of generating a polarity vector by arranging a unit pulse in which one of the positive and the negative is selected as a polarity in a position of the element based on a polarity of an element of the second reference vector.

A speech coding method according to the present invention is a speech coding method for encoding an input speech signal by searching for a pulse using an algebraic codebook formed with a plurality of code vectors and employs a configuration to include a target vector generating step of calculating the first parameter related to a perceptual characteristic and the second parameter related to a spectrum characteristic using the speech signal, and generating a target vector to be encoded using the first parameter and the second parameter; a parameter calculating step of generating a third parameter related to both the perceptual characteristic and the spectrum characteristic using the first parameter and the second parameter; the first vector calculating step of calculating the first reference vector by applying the third parameter to the target vector; the second vector calculating step of calculating the second reference vector by multiplying the first reference vector by a filter having a high-pass characteristic; and a polarity selecting step of generating a polarity vector by arranging a unit pulse in which one of the positive and the negative is selected in a position of the element as a polarity based on a polarity of an element of the second reference vector.

Advantageous Effects of Invention

According to the present invention, it is possible to provide a vector quantization apparatus, a speech coding apparatus, a vector quantization method, and a speech coding method which can reduce the amount of speech codec calculation with no degradation of speech quality by reducing an erroneous selection in pre-selection of a fixed codebook pulse polarity.

DESCRIPTION OF EMBODIMENT

Hereinafter, an embodiment of the present invention will be described in detail with reference to the accompanying drawings.

Figure 1:
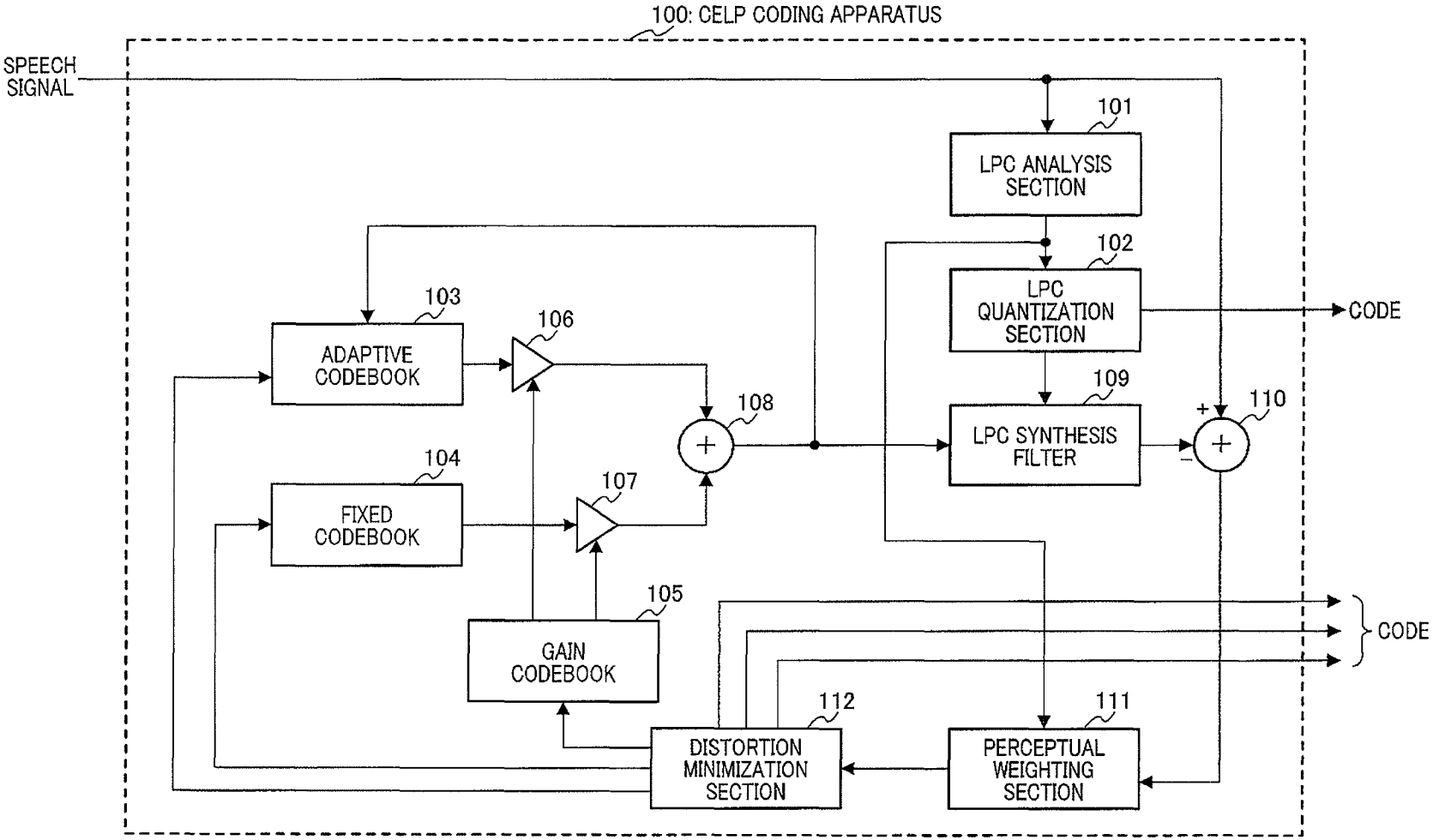
FIG. 1 is a block diagram showing the configuration of a CELP coding apparatus according to an embodiment of the present invention.

FIG. 1 is a block diagram showing the basic configuration of CELP coding apparatus 100 according to an embodiment of the present invention. As employed in a great number of standard schemes, CELP coding apparatus 100 includes an adaptive codebook search apparatus, a fixed codebook search apparatus, and a gain codebook search apparatus. FIG. 1 shows a basic structure simplifying these apparatuses together.

In FIG. 1, for a speech signal comprising vocal tract information and excitation information, CELP coding apparatus 100 encodes vocal tract information by finding an LPC parameter (linear predictive coefficients), and encodes excitation information by finding an index that specifies whether to use one of previously stored speech models. That is to say, excitation information is encoded by finding an index (code) that specifies what kind of excitation vector (code vector) is generated by adaptive codebook 103 and fixed codebook 104.

In FIG. 1, CELP coding apparatus 100 includes LPC analysis section 101, LPC quantization section 102, adaptive codebook 103, fixed codebook 104, gain codebook 105, multiplier 106, 107, and LPC synthesis filter 109, adder 110, perceptual weighting section 111, and distortion minimization section 112.

LPC analysis section 101 executes linear predictive analysis on a speech signal, finds an LPC parameter that is spectrum envelope information, and outputs the found LPC parameter to LPC quantization section 102 and perceptual weighting section 111.

LPC quantization section 102 quantizes the LPC parameter output from LPC analysis section 101, and outputs the acquired quantized LPC parameter to LPC synthesis filter 109. LPC quantization section 102 outputs a quantized LPC parameter index to outside CELP coding apparatus 100.

Adaptive codebook 103 stores excitations used in the past by LPC synthesis filter 109. Adaptive codebook 103 generates an excitation vector of one-subframe from the stored excitations in accordance with an adaptive codebook lag corresponding to an index instructed by distortion minimization section 112 described later herein. This excitation vector is output to multiplier 106 as an adaptive codebook vector.

Fixed codebook 104 stores beforehand a plurality of excitation vectors of predetermined shape. Fixed codebook 104 outputs an excitation vector corresponding to the index instructed by distortion minimization section 112 to multiplier 107 as a fixed codebook vector. Here, fixed codebook 104 is an algebraic excitation, and a case of using an algebraic codebook will be described. Also, an algebraic excitation is an excitation adopted to many standard codecs.

Further, above adaptive codebook 103 is used for representing components of strong periodicity like voiced speech, while fixed codebook 104 is used for representing components of weak periodicity like white noise.

Gain codebook 105 generates a gain for an adaptive codebook vector output from adaptive codebook 103 (adaptive codebook gain) and a gain for a fixed codebook vector output from fixed codebook 104 (fixed codebook gain) in accordance with an instruction from distortion minimization section 112, and outputs these gains to multipliers 106 and 107 respectively.

Multiplier 106 multiplies the adaptive codebook vector output from adaptive codebook 103 by the adaptive codebook gain output from gain codebook 105, and outputs the multiplied adaptive codebook vector to adder 108.

Multiplier 107 multiplies the fixed codebook vector output from fixed codebook 104 by the fixed codebook gain output from gain codebook 105, and outputs the multiplied fixed codebook vector to adder 108.

Adder 108 adds the adaptive codebook vector output from multiplier 106 and the fixed codebook vector output from multiplier 107, and outputs the resulting excitation vector to LPC synthesis filter 109 as excitations.

LPC synthesis filter 109 generates a filter function including the quantized LPC parameter output from LPC quantization section 102 as a filter coefficient and an excitation vector generated in adaptive codebook 103 and fixed codebook 104 as excitations. That is to say, LPC synthesis filter 109 generates a synthesized signal of an excitation vector generated by adaptive codebook 103 and fixed codebook 104 using an LPC synthesis filter. This synthesized signal is output to adder 110.

Adder 110 calculates an error signal by subtracting the synthesized signal generated in LPC synthesis filter 109 from a speech signal, and outputs this error signal to perceptual weighting section 111. Here, this error signal is equivalent to coding distortion.

Perceptual weighting section 111 performs perceptual weighting for the coding distortion output from adder 110, and outputs the result to distortion minimization section 112.

Distortion minimization section 112 finds the indexes (code) of adaptive codebook 103, fixed codebook 104 and gain codebook 105 on a per subframe basis, so as to minimize the coding distortion output from perceptual weighting section 111, and outputs these indexes to outside CELP coding apparatus 100 as encoded information. That is to say, three apparatuses included in CELP coding apparatus 100 are respectively used in the order of an adaptive codebook search apparatus, a fixed codebook search apparatus, and a gain codebook search apparatus to find codes in a subframe, and each apparatus performs a search so as to minimize distortion.

Here, a series of processing steps for generating a synthesized signal based on adaptive codebook 103 and fixed codebook 104 above and finding coding distortion of this signal form closed loop control (feedback control). Accordingly, distortion minimization section 112 searches for each codebook by variously changing indexes that designate each codebook in one subframe, and outputs finally acquired indexes of each codebook that minimize coding distortion.

Also, the excitation in which the coding distortion is minimized is fed back to adaptive codebook 103 on a per subframe basis. Adaptive codebook 103 updates stored excitations by this feedback.

A method for searching adaptive codebook 103 will now be described. Generally, an adaptive codebook vector is searched by an adaptive codebook search apparatus and a fixed codebook vector is searched by a fixed codebook search apparatus using open loops (separate loops) respectively. An adaptive excitation vector search and index (code) derivation are performed by searching for an excitation vector that minimizes coding distortion in equation 1 below.

[1]

$$E=|x-g_pHp|^2 \quad \text{(Equation 1)}$$

E: coding distortion, x: target vector (perceptual weighting speech signal), p: adaptive codebook vector, H: perceptual weighting LPC synthesis filter (impulse response matrix), $g_p$: adaptive codebook vector ideal gain Here, if gain $g_p$ is assumed to be an ideal gain, $g_p$ can be eliminated by utilizing that an equation resulting from partial differentiation of equation 1 above with $g_p$ becomes 0. Accordingly, equation 1 above can be transformed into the cost function in equation 2 below. Suffix t represents vector transposition in equation 2.

(Equation 2)

$$\frac{x^tHp}{\sqrt{p^tH^tHp}} \quad [2]$$

That is to say, adaptive codebook vector p that minimizes coding distortion E in equation 1 above maximizes the cost function in equation 2 above. However, for being limited to a case in which target vector x and adaptive codebook vector Hp (synthesized adaptive codebook vector) with which impulse response H is convolved have a positive correlation, the numerator term in equation 2 is not squared, and the square root of the denominator term is found. That is to say, the numerator term in equation 2 represents a correlation value between target vector x and synthesized adaptive codebook vector Hp, and the denominator term in equation 2 represents a square root of the power of synthesized adaptive codebook vector Hp.

At the time of an adaptive codebook 103 search, CELP coding apparatus 100 searches for adaptive codebook vector p that maximizes the cost function shown in equation 2, and outputs an index (code) of an adaptive codebook vector that maximizes the cost function to outside CELP coding apparatus 100.

Figure 2:
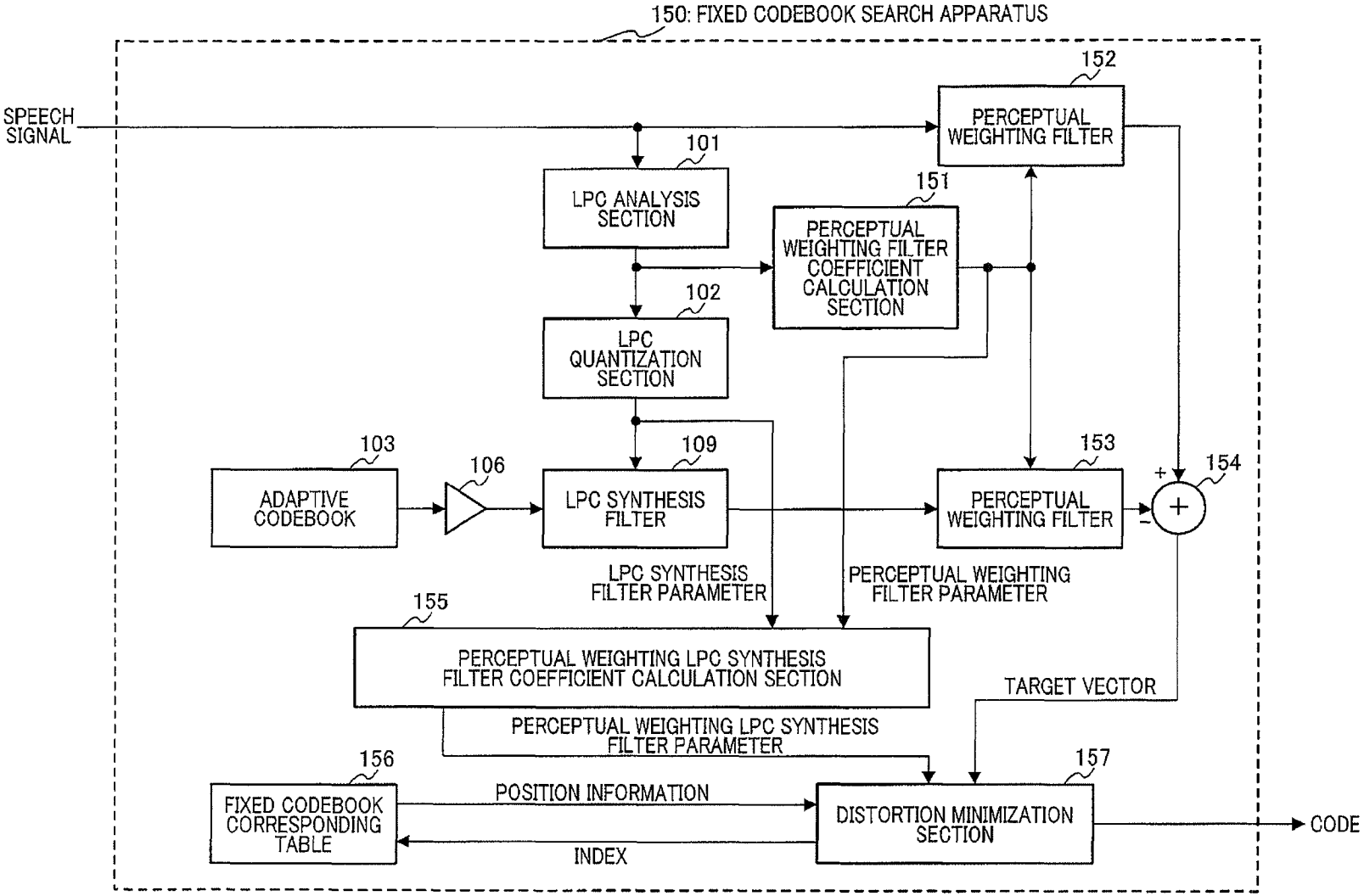
FIG. 2 is a block diagram showing the configuration of a fixed codebook search apparatus according to an embodiment of the present invention.

Next, a method for searching fixed codebook 104 will be described. FIG. 2 is a block diagram showing the configuration of fixed codebook search apparatus 150 according to the present embodiment. As described above, in encoding target subframe, after the search in an adaptive codebook search apparatus (not shown), a search is performed in fixed codebook search apparatus 150. In FIG. 2, parts that configure fixed codebook search apparatus 150 are extracted from CELP coding apparatus in FIG. 1 and specific configuration elements required upon configuration are additionally described. Configuration elements in FIG. 2 identical to those in FIG. 1 are assigned the same reference numbers as in FIG. 1, and duplicate descriptions thereof are omitted here. In the following description, it is assumed that the number of pulses is two, a subframe length (vector length) is 64 samples.

Fixed codebook search apparatus 150 includes LPC analysis section 101, LPC quantization section 102, adaptive codebook 103, multiplier 106, LPC synthesis filter 109, perceptual weighting filter coefficient calculation section 151, perceptual weighting filter 152 and 153, adder 154, perceptual weighting LPC synthesis filter coefficient calculation section 155, fixed codebook corresponding table 156, and distortion minimization section 157.

A speech signal input to fixed codebook search apparatus 150 received to LPC analysis section 101 and perceptual weighting filter 152 as input. LPC analysis section 101 executes linear predictive analysis on a speech signal, and finds an LPC parameter that is spectrum envelope information. However, an LPC parameter that is normally found upon an adaptive codebook search, is employed herein. This LPC parameter is transmitted to LPC quantization section 102 and perceptual weighting filter coefficient calculation section 151.

LPC quantization section 102 quantizes the input LPC parameter, generates a quantized LPC parameter, outputs the quantized LPC parameter to LPC synthesis filter 109, and outputs the quantized LPC parameter to perceptual weighting LPC synthesis filter coefficient calculation section 155 as an LPC synthesis filter parameter.

LPC synthesis filter 109 receives as input an adaptive excitation output from adaptive codebook 103 in association with an adaptive codebook index already found in an adaptive codebook search through multiplier 106 multiplying a gain. LPC synthesis filter 109 performs filtering for the input adaptive excitation multiplied by a gain using a quantized LPC parameter, and generates an adaptive excitation synthesized signal.

Perceptual weighting filter coefficient calculation section 151 calculates perceptual weighting filter coefficients using an input LPC parameter, and outputs these to perceptual weighting filter 152, 153, and perceptual weighting LPC synthesis filter coefficient calculation section 155 as a perceptual weighting filter parameter.

Perceptual weighting filter 152 performs perceptual weighting filtering for an input speech signal using a perceptual weighting filter parameter input from perceptual weighting filter coefficient calculation section 151, and outputs the perceptual weighted speech signal to adder 154.

Perceptual weighting filter 153 performs perceptual weighting filtering for the input adaptive excitation vector synthesized signal using a perceptual weighting filter parameter input from perceptual weighting filter coefficient calculation section 151, and outputs the perceptual weighted synthesized signal to adder 154.

Adder 154 adds the perceptual weighted speech signal output from perceptual weighting filter 152 and a signal in which the polarity of the perceptual weighted synthesized signal output from perceptual weighting filter 153 is inverted, thereby generating a target vector as an encoding target and outputting the target vector to distortion minimization section 157.

Perceptual weighting LPC synthesis filter coefficient calculation section 155 receives an LPC synthesis filter parameter as input from LPC quantization section 102, while receiving a perceptual weighting filter parameter from perceptual weighting filter coefficient calculation section 151 as input, and generates a perceptual weighting LPC synthesis filter parameter using these parameters and outputs the result to distortion minimization section 157.

Fixed codebook corresponding table 156 stores pulse position information and pulse polarity information forming a fixed codebook vector in association with an index. When an index is designated from distortion minimization section 157, fixed codebook corresponding table 156 outputs pulse position information corresponding to the index distortion minimization section 157.

Distortion minimization section 157 receives as input a target vector from adder 154 and receives as input a perceptual weighting LPC synthesis filter parameter from perceptual weighting LPC synthesis filter coefficient calculation section 155. Also, distortion minimization section 157 repeats outputting of an index to fixed codebook corresponding table 156, and receiving of pulse position information and pulse polarity information corresponding to an index as input the number of search loops times set in advance. Distortion minimization section 157 adopts a target vector and a perceptual weighting LPC synthesis parameter, finds an index (code) of a fixed codebook that minimizes coding distortion by a search loop, and outputs the result. A specific configuration and operation of distortion minimization section 157 will be described in detail below.

Figure 3:
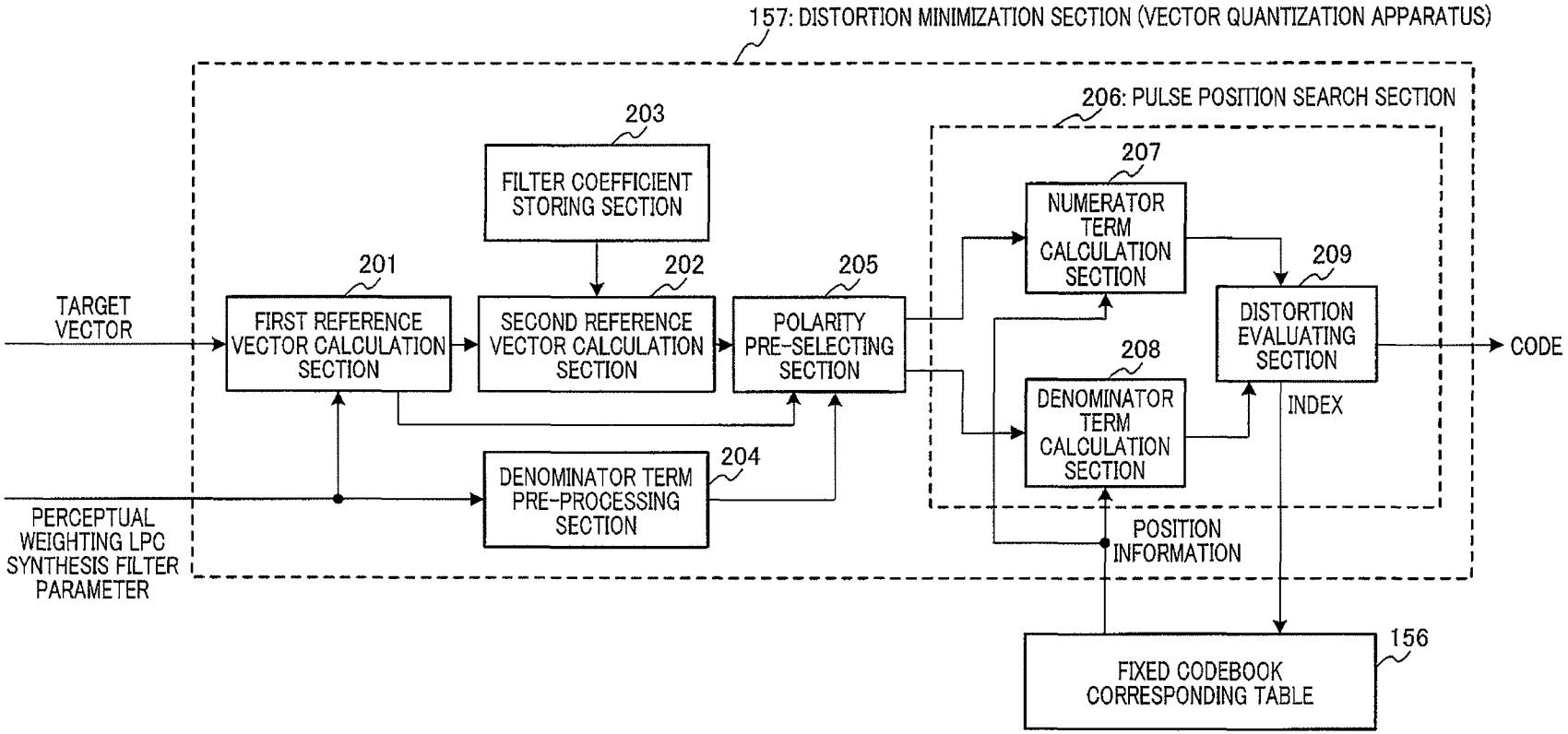
FIG. 3 is a block diagram showing the configuration of a vector quantization apparatus according to an embodiment of the present invention.

FIG. 3 is a block diagram showing the configuration inside distortion minimization section 157 according to the present embodiment. Distortion minimization section 157 is a vector quantization apparatus that receives as input a target vector as an encoding target and performs quantization.

Distortion minimization section 157 receives target vector x as input. This target vector x is output from adder 154 in FIG. 2. Calculation equation is represented by following equation 3.

[3]

$$x=Wy-g_pHp \quad \text{(Equation 3)}$$

x: target vector (perceptual weighting speech signal), y: input speech (corresponding to "a speech signal" in FIG. 1), $g_p$: adaptive codebook vector ideal gain (scalar), H: perceptual weighting LPC synthesis filter (matrix), p: adaptive excitation (adaptive codebook vector), W: perceptual weighting filter (matrix)

That is to say, as shown in equation 3, target vector x is found by subtracting adaptive excitation p multiplied by ideal gain $g_p$ acquired upon an adaptive codebook search and perceptual weighting LPC synthesis filter H, from input speech y multiplied by perceptual weighting filter W.

In FIG. 3, distortion minimization section 157 (a vector quantization apparatus) includes first reference vector calculation section 201, second reference vector calculation section 202, filter coefficient storing section 203, denominator term pre-processing section 204, polarity pre-selecting section 205, and pulse position search section 206. Pulse position search section 206 is formed with numerator term calculation section 207, denominator term calculation section 208, and distortion evaluating section 209 as an example.

First reference vector calculation section 201 calculates the first reference vector using target vector x and perceptual weighting LPC synthesis filter H. Calculation equation is represented by following equation 4.

[4]

$$v'=x'H \quad \text{(Equation 4)}$$

v: first reference vector, suffix t: vector transposition

That is to say, as shown in equation 4, the first reference vector is found by multiplying target vector x by perceptual weighting LPC synthesis filter H.

Denominator term pre-processing section 204 calculates a matrix (hereinafter, referred to as "a reference matrix") for calculating the denominator term of equation 2. Calculation equation is represented by following equation 5.

[5]

$$M=H'H \quad \text{(Equation 5)}$$

M: reference matrix

That is to say, as shown in equation 5, a reference matrix is found by multiplying matrixes of perceptual weighting LPC synthesis filter H. This reference matrix is used for finding the power of a pulse which is the denominator term of the cost function.

Second reference vector calculation section 202 multiplies the first reference vector by a filter using filter coefficients stored in filter coefficient storing section 203. Here, a filter order is assumed to be cubic, and filter coefficients are set to {−0.35, 1.0, −0.35}. An algorithm for calculating the second reference vector by this filter is represented by following equation 6.

[6]

$$\text{if } (i=0)\ u_0=1.0\cdot v_0-0.35\cdot v_1$$

$$\text{elseif } (i=63)\ u_{63}=-0.35\cdot v_{62}+1.0\cdot v_{63}$$

$$\text{else } u_i=-0.35\cdot v_{i-1}+1.0\cdot v_i-0.35\cdot v_{i+1} \quad \text{(Equation 6)}$$

$u_i$: second reference vector, i: vector element index

That is to say, as shown in equation 6, the second reference vector is found by multiplying the first reference vector by a MA (Moving Average) filter. The filter used here has a high-pass characteristic. In this embodiment, in the case of using a portion protruding from a vector for calculation, the value of the portion is assumed to be 0.

Polarity pre-selecting section 205 first checks a polarity of each element of the second reference vector and generates a polarity vector (that is to say, a vector including +1 and −1 as an element). That is to say, polarity pre-selecting section 205 generates a polarity vector by arranging unit pulses in which either the positive or the negative is selected as a polarity in positions of the elements based on the polarity of the second reference vector elements. This algorithm is represented by following equation 7.

[7]

$$\text{if } u_i \geq 0 \text{ then } s_i=1.0 \text{ else } s_i=-1.0\ i=0\ldots63 \quad \text{(Equation 7)}$$

$s_i$: polarity vector, i: vector element index

That is to say, as shown in equation 7, the element of a polarity vector is determined to be +1 if the polarity of each element of the second reference vector is positive or 0, and is determined to be −1 if the polarity of each element of the second reference vector is negative.

Polarity pre-selecting section 205 second finds "an adjusted first reference vector" and "an adjusted reference matrix" by previously multiplying each of the first reference vector and the reference matrix by a polarity using the acquired polarity vector. This calculation method is represented by following equation 8.

[8]

$$\hat{v}_i=v_i\cdot s_i\ i=0\ldots63$$

$$\hat{M}_{i,j}=M_{i,j}\cdot s_i\cdot s_j\ i=0\ldots63,\ j=0\ldots63 \quad \text{(Equation 8)}$$

$\hat{v}_i$: adjusted first reference vector, $\hat{M}_{i,j}$: adjusted reference matrix, i, j: index That is to say, as shown in equation 8, the adjusted first reference vector is found by multiplying each element of the first reference vector by the values of polarity vector in positions corresponding to the elements. Also, the adjusted reference matrix is found by multiplying each element of the reference matrix by the values of polarity vector in positions corresponding to the elements. By this means, a pre-selected pulse polarity is incorporated into the adjusted first reference vector and the adjusted reference matrix.

Pulse position search section 206 searches for a pulse using the adjusted first reference vector and the adjusted reference matrix. Then, pulse position search section 206 outputs codes corresponding to a pulse position and a pulse polarity as a search result. That is to say, pulse position search section 206 searches for an optimal pulse position that minimizes coding distortion. Non-Patent Literature 1 discloses this algorithm around equation 58 and 59 in chapter 3.8.1 in detail. A correspondence relationship between the vector and the matrix according to the present embodiment, and variables in Non-Patent Literature 1 is shown in following equation 9.

[9]

$$\hat{v}_i \Leftrightarrow d'(i)$$

$$\hat{M}_{i,j} \Leftrightarrow \phi'(i,j) \quad \text{(Equation 9)}$$

Present Embodiment

Non-Patent Literature 1

An example of this algorithm will be briefly described using FIG. 3. Pulse position search section 206 receives as input an adjusted first reference vector and an adjusted reference matrix from polarity pre-selecting section 205, and inputs the adjusted first reference vector numerator term calculation section 207 and inputs the adjusted reference matrix to denominator term calculation section 208.

Numerator term calculation section 207 applies position information input from fixed codebook corresponding table 156 to the input adjusted first reference vector and calculates the value of the numerator term of equation 53 in Non-Patent Literature 1. The calculated value of the numerator term is output to distortion evaluating section 209.

Denominator term calculation section 208 applies position information input from fixed codebook corresponding table 156 to the input adjusted reference matrix and calculates the value of the denominator term of equation 53 in Non-Patent Literature 1. The calculated value of the denominator term is output to distortion evaluating section 209.

Distortion evaluating section 209 receives as input the value of a numerator term from numerator term calculation section 207 and the value of a denominator term from denominator term calculation section 208, and calculates distortion evaluation equation (equation 53 in Non-Patent Literature 1). Distortion evaluating section 209 outputs indexes to fixed codebook corresponding table 156 the number of search loops times set in advance. Every time an index is input from distortion evaluating section 209, fixed codebook corresponding table 156 outputs pulse position information corresponding to the index to numerator term calculation section 207 and denominator term calculation section 208, and outputs pulse position information corresponding to the index to denominator term calculation section 208. By performing such a search loop, pulse position search section 206 finds and outputs an index (code) of the fixed codebook which minimizes coding distortion.

Here, a result of a simulation experiment for verifying an effect of the present embodiment will be described. CELP employed for the experiment is "ITU-T G.718" (see Non-Patent Literature 2) which is the latest standard scheme. The experiment is performed by respectively applying each of conventional polarity pre-selection in Non-Patent Literature 1 and Patent Literature 1 and the present embodiment to a mode for searching a two-pulse algebraic codebook in this standard scheme (see chapter 6.8.4.1.5 in Non-Patent Literature 2) and each effect is examined.

The aforementioned two-pulse mode of "ITU-T G.718" is the same condition as an example described in the present embodiment, that is to say, a case where the number of pulses are two, a subframe length (vector length) is 64 samples. As a method for searching a position and a polarity in ITU-T G.718, the amount of calculation is large since there is employed a method for searching all combinations which are simultaneously optimal.

Then, the polarity pre-selecting method used in both Non-Patent Literature 1 and Patent Literature 1 was adopted. 16 speech (Japanese) to which various noises were added was used for test data.

As a result, the amount of calculation is reduced to an approximately half by polarity pre-selection used in both Non-Patent Literature 1 and Patent Literature 1. However, a large number of polarities of the polarities searched by the polarity pre-selection are different from the polarities searched by the whole search using a standard scheme. To be specific, an average of an erroneous selection was 0.9%. The erroneous selection directly causes degradation of sound quality.

In contrast, in a case where polarity pre-selection according to the present embodiment is adopted, the degree of reduction in the amount of calculation is reduced to an approximately half as in a case where polarity pre-selection used in both Non-Patent Literature 1 and Patent Literature 1 is adopted. When polarity pre-selection according the present embodiment was adopted, an erroneous selection rate was reduced to an average 0.4%. In a case where polarity pre-selection according to the present embodiment was adopted, an erroneous selection rate was reduced to less than or equal to half in the case of adopting polarity pre-selection used in both Non-Patent Literature 1 and Patent Literature 1.

In view of the above, it was verified that the polarity pre-selection method according to the present embodiment can reduce a large amount of calculation and further significantly reduces an erroneous selection rate compared to the conventional polarity pre-selection method used in both Non-Patent Literature 1 and Patent Literature 1, thereby improving speech quality.

As described above, according to the present embodiment, in CELP coding apparatus 100, first reference vector calculation section 201 calculates the first reference vector by multiplying target vector x by perceptual weighting LPC synthesis filter H and second reference vector calculation section 202 calculates the second reference vector by multiplying an element of the first reference vector by a filter having a high-pass characteristic. Then polarity pre-selecting section 205 selects a pulse polarity of each element position based on the positive and the negative of each element of the second reference vector.

Thus, by the feature of the present invention that calculates the second reference vector using a filter with a high-pass characteristic, the polarity of the second reference vector element has a pulse polarity that readily changes to the positive or the negative. (That is to say, a low-frequency component is reduced by a high-pass filter, and a "shape" with a high frequency is made) As a result of the basic experiment, it is obvious to have a high possibility that pulse polarity erroneous selection occurs in "a case where, when pulses adjacent to each other are selected, the pulses having different polarities are optimal in the whole search, even though polarities of these pulses are the same in the first reference vector." Accordingly, "polarity changeability" of the present invention can reduce possibility that the above erroneous selection occurs. Then, polarity pre-selecting section 205 selects a pulse polarity of each element position based on the positive or the negative of each element of the second reference vector, thereby enabling an erroneous selection rate to be reduced. Accordingly, it is possible to reduce the amount of speech codec with no degradation of speech quality.

It is noted that, in the above description, although it is assumed that the number of pulses are two and a subframe length is 64, these values are examples and it is obvious that the present invention is effective in any specification. Also, as described in equation 6, although a filter order is set to be cubic, but in the present invention, it obvious that other order may be applicable. The filter coefficients used in the above description is not limited thereto. It is obvious that the numerical value and specification is not limited in the present invention.

In the above description, the first reference vector generated in first reference vector calculation section 201 is found by multiplying target vector x by perceptual weighting LPC synthesis filter H. However, when distortion minimization section 157 is considered as a vector quantization apparatus that acquires a code indicating a code vector that minimizes coding distortion by performing a pulse search using an algebraic codebook formed with a plurality of code vectors, a perceptual weighting LPC synthesis filter is not always applied to a target vector. For example, only a parameter related to a spectrum characteristic may be applicable as a parameter that reflects on a speech characteristic.

Also, in the above description, a case has been described where the present invention is applied to quantization of an algebraic codebook, it is obvious that the present invention may be applicable to multiple-stage (multi-channel) fixed codebook in other form. That is to say, the present invention can be applied to all codebooks encoding a polarity.

Also, although an embodiment using CELP has been shown in the above description, since the present invention can be utilized for vector quantization, it is obvious that the application thereof is not limited to CELP. For example, the present invention can be utilized for spectrum quantization utilizing MDCT (Modified Discrete Cosine Transform) or QMF (Quadrature Mirror Filter) and can be also utilized for an algorithm for searching a similar spectrum shape from a low-frequency spectrum in a band expansion technology. By this means, the amount of calculation is reduced. That is to say, the present invention can be applied to all encoding schemes that encode polarities.

Although an example case has been described above where the present invention is configured with hardware, the present invention can be implemented with software as well.

Furthermore, each function block used in the above description may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2009-283247, filed on Dec. 14, 2009, including the specification, drawings and abstract, is incorporated herein by reference in its entirety.

INDUSTRIAL APPLICABILITY

A vector quantization apparatus, a speech coding apparatus, a vector quantization method, and a speech coding method according to the present invention is useful for reducing the amount of speech codec calculation without degrading speech quality.

REFERENCE SIGNS LIST

100 CELP coding apparatus
101 LPC analysis section
102 LPC quantization section
103 Adaptive codebook
104 Fixed codebook
105 Gain codebook
106, 107 Multiplier
108, 110, 154 Adder
109 LPC Synthesis filter
111 Perceptual weighting section
112, 157 Distortion minimization section
150 Fixed codebook search apparatus
151 Perceptual weighting filter coefficient calculation section
152, 153 Perceptual weighting filter
155 Perceptual weighting LPC synthesis filter coefficient calculation section
156 Fixed codebook corresponding table
201 First reference vector calculation section
202 Second reference vector calculation section
203 Filter coefficient storing section
204 Denominator term pre-processing section
205 Polarity pre-selecting section
206 Pulse position search section
207 Numerator term calculation section
208 Denominator term calculation section
209 Distortion evaluating section

The invention claimed is:

1. A vector quantization apparatus comprising:

a first vector calculator that calculates, using a processor, a first reference vector by applying a parameter related to a speech spectrum characteristic to a target vector to be encoded, and transmits the first reference vector to both a second vector calculator and a polarity selector;

a matrix calculator that calculates a reference matrix by matrix calculation using the parameter;

the second vector calculator that calculates a second reference vector by multiplying the first reference vector by a filter having a high-pass characteristic;

the polarity selector that generates a polarity vector based on a polarity of each element of the second reference vector, and generates an adjusted first reference vector by multiplying the first reference vector by the polarity vector, and generates an adjusted reference matrix by multiplying the reference matrix by the polarity vector; and a pulse position searcher that searches for an optimal pulse position using the adjusted first reference vector and the adjusted reference matrix.

2. The vector quantization apparatus according to claim 1, wherein the polarity vector is generated using only polarity, among the polarity and pulse position, of each element of the second reference vector.

3. The vector quantization apparatus according to claim 1, wherein the optimal pulse position is based on pulse position information of the first reference vector and polarity information of the second reference vector.

4. A speech coding apparatus comprising:

a target vector generator that calculates, using a processor, a first parameter related to a perceptual characteristic and a second parameter related to a spectrum characteristic using a speech signal, and generates a target vector to be encoded using the first parameter and the second parameter;

a parameter calculator that generates a third parameter related to both the perceptual characteristic and the spectrum characteristic using the first parameter and the second parameter;

a first vector calculator that calculates a first reference vector by applying the third parameter to the target vector, and transmits the first reference vector to both a second vector calculator and a polarity selector;

a matrix calculator that calculates a reference matrix by matrix calculation using the third parameter;

the second vector calculator that calculates a second reference vector by multiplying the first reference vector by a filter having a high-pass characteristic;

the polarity selector that generates a polarity vector based on a polarity of each element of the second reference vector and generates an adjusted first reference vector by multiplying the first reference vector by the polarity vector, and generates an adjusted reference matrix by multiplying the reference matrix by the polarity vector; and a pulse position searcher that searches for an optimal pulse position using the adjusted first reference vector and the adjusted reference matrix.

5. The speech coding apparatus according to claim 4, wherein the pulse position searcher comprises:

a distortion evaluator that calculates coding distortion using a distortion evaluation equation set in advance;

a numerator term calculator that calculates a value of a numerator term of the distortion evaluation equation using the adjusted first reference vector and pulse position information input from the algebraic codebook; and a denominator term calculator that calculates a value of a denominator term of the distortion evaluation equation using the adjusted reference matrix and pulse position information input from the algebraic codebook, wherein the distortion evaluator searches for the optimal pulse position by calculating the coding distortion by applying the value of the numerator term and the value of the denominator term to the distortion evaluation equation.

6. A vector quantization method for searching for a pulse position comprising:

calculating, using a processor, a first reference vector by applying a parameter related to a speech spectrum characteristic to a target vector to be encoded;

transmitting, via two separate paths, the first reference vector for both calculating a second reference vector and generating an adjusted reference vector;

calculating a reference matrix by matrix calculation using the third parameter;

calculating the second reference vector by multiplying the first reference vector by a filter having a high-pass characteristic;

generating a polarity vector based on a polarity of each element of the second reference vector;

generating the adjusted first reference vector by multiplying the first reference vector by the polarity vector;

generating an adjusted reference matrix by multiplying the reference matrix by polarity vector; and searching, using the adjusted first reference vector and the adjusted reference matrix, for an optimal pulse position that minimizes the coding distortion.

7. A speech coding method comprising:

calculating, using a processor, a first parameter related to a perceptual characteristic and a second parameter related to a spectrum characteristic using a speech signal, and generating a target vector to be encoded using the first parameter and the second parameter;

generating a third parameter related to both the perceptual characteristic and the spectrum characteristic using the first parameter and the second parameter;

calculating a first reference vector by applying the third parameter to the target vector;

transmitting, via two separate paths, the first reference vector for both calculating a second reference vector and generating an adjusted reference vector;

calculating a reference matrix by matrix calculation using the third parameter;

calculating the second reference vector by multiplying the first reference vector by a filter having a high-pass characteristic;

generating a polarity vector based on a polarity of each element of the second reference vector;

generating the adjusted first reference vector by multiplying the first reference vector by the polarity vector;

generating an adjusted reference matrix by multiplying the reference matrix by the polarity vector; and searching, using the adjusted first reference vector and the adjusted reference matrix, for an optimal pulse position that minimizes coding distortion.

* * * * *